US005207238A

United States Patent [19]

Rivera et al.

[11] Patent Number: 5,207,238

[45] Date of Patent: May 4, 1993

[54] AIR FLOW LOUNGE UMBRELLA APPARATUS

[76] Inventors: Rose F. Rivera; Robert A. Rivera, both of 706 N. Padre Ave., Weslaco, Tex. 78596

[21] Appl. No.: 790,827

[22] Filed: Nov. 12, 1991

[51] Int. Cl.[5] ..... A45B 3/00

[52] U.S. Cl. ..... 135/16; 135/28; 135/31

[58] Field of Search ..... 135/20.2, 25.4, 28, 135/31, 16

[56] References Cited

U.S. PATENT DOCUMENTS

| | | | |
|---|---|---|---|
| 574,091 | 12/1896 | Irvine, Jr. | 135/16 |
| 3,444,799 | 5/1969 | Covington | 135/16 X |
| 3,739,792 | 6/1973 | Holland | 135/16 |
| 3,910,631 | 10/1975 | Inaba | 135/16 X |
| 4,505,285 | 3/1985 | French | 135/16 X |
| 4,711,260 | 12/1987 | Wiens et al. . | |
| 4,798,219 | 1/1989 | Iorde . | |
| 4,915,670 | 4/1990 | Nesbit . | |
| 5,046,699 | 9/1991 | Perreault et al. | 135/16 X |

*Primary Examiner*—Carl D. Friedman
*Assistant Examiner*—Lan M. Mai
*Attorney, Agent, or Firm*—Leon Gilden

[57] ABSTRACT

An umbrella canopy mounted to a post structure is arranged to include a base support, wherein the base support directs pressurized air through the post support, that in turn includes a matrix of apertures directed therethrough that are selectively blocked by individuals to permit air flow onto such individuals positioned about an associated table structure relative to the post support.

4 Claims, 5 Drawing Sheets

AIR FLOW LOUNGE UMBRELLA APPARATUS

BACKGROUND OF THE INVENTION

1. Field of the Invention

The field of invention relates to umbrella apparatus, and more particularly pertains to a new and improved air flow lounge umbrella apparatus wherein the same is arranged to direct pressurized air onto individuals to aid in comfort and enjoyment in an outdoor environment.

2. Description of the Prior Art

Prior art patents of various types are utilized to accommodate umbrellas and their associated structure relative to a particular environment. Specifically, in outdoor lounging frequently the unavailability of air flow limits enjoyment of such outdoor situations. The instant invention attempts to overcome deficiencies of the prior art by providing selective air flow to such individuals in this outdoor environment. Prior art structure exemplary of umbrella construction is illustrated in U.S. Pat. No. 4,915,670 to Nesbit wherein an umbrella includes a radio receiver for use in cooperation with the umbrella structure.

U.S. Pat. No. 4,798,219 to Forde sets forth an umbrella package, wherein a golf pick-up device may be provided to further include an umbrella structure in a unitary organization.

U.S. Pat. No. 4,711,260 to Wiens, et al. sets forth an umbrella convertible between an umbrella and a golfing back stop.

As such, it may be appreciated that there continues to be a need for a new and improved air flow lounge umbrella apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of umbrella apparatus now present in the prior art, the present invention provides an air flow lounge umbrella apparatus wherein the same is arranged to direct selective air flow to individuals seated about the umbrella organization. As such, the general purpose of the present invention, which will be described subsequently in greater detail, is to provide a new and improved air flow lounge umbrella apparatus which has all the advantages of the prior art umbrella apparatus and none of the disadvantages.

To attain this, the present invention provides an umbrella canopy mounted to a post structure arranged to include a base support, wherein the base support includes a matrix of apertures directed therethrough that are selectively blocked by individuals to permit air flow onto such individual positioned about an associated table structure relative to the post support.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved air flow lounge umbrella apparatus which has all the advantages of the prior art umbrella apparatus and none of the disadvantages.

It is another object of the present invention to provide a new and improved air flow lounge umbrella apparatus which may be easily and efficiently manufactured and marketed.

It is a further object of the present invention to provide a new and improved air flow lounge umbrella apparatus which is of a durable and reliable construction.

An even further object of the present invention is to provide a new and improved air flow lounge umbrella apparatus which is susceptible of a low cost of manufacture with regard to both materials and labor, and which accordingly is then susceptible of low prices of sale to the consuming public, thereby making such air flow lounge umbrella apparatus economically available to the buying public.

Still yet another object of the present invention is to provide a new and improved air flow lounge umbrella apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
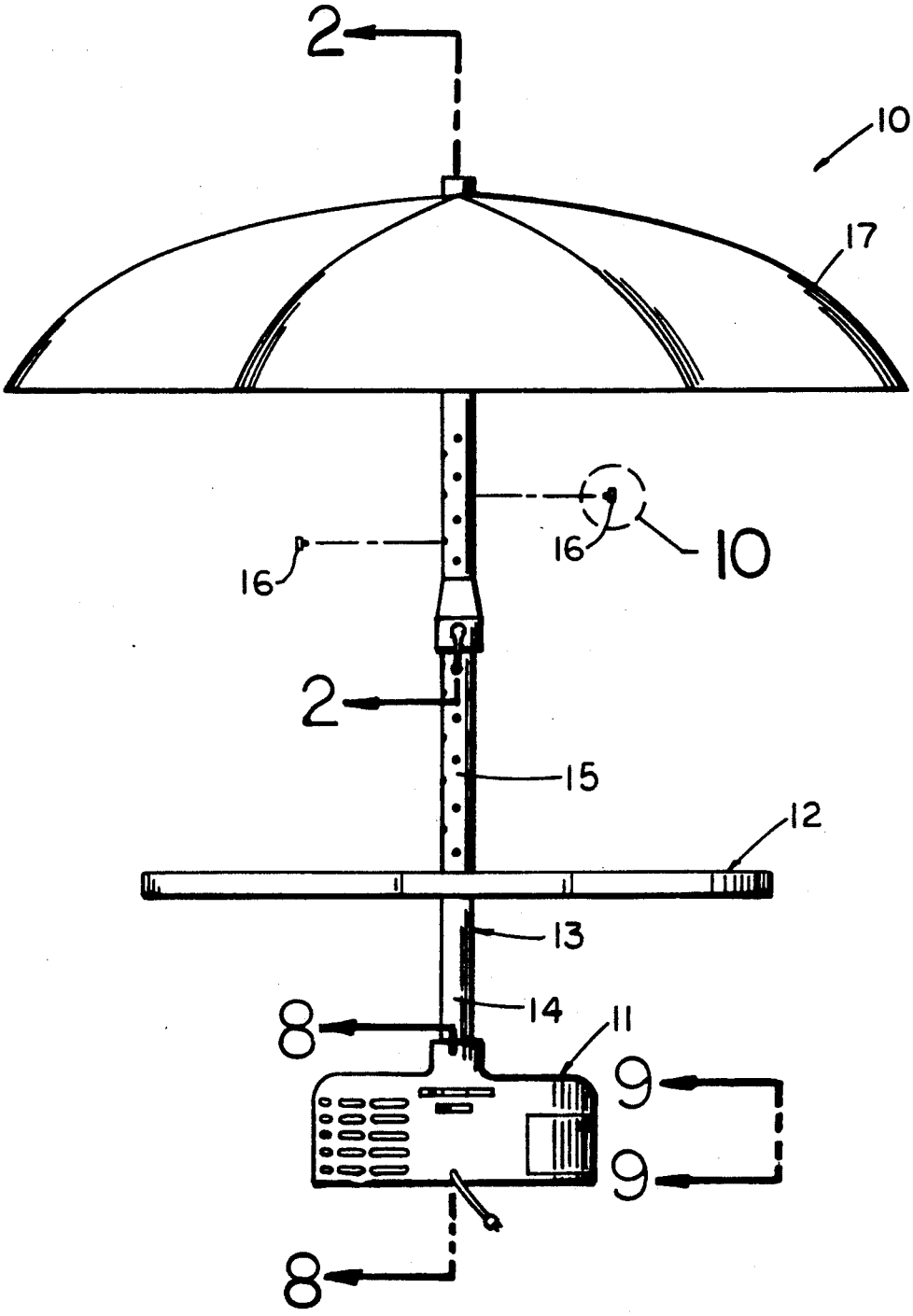
FIG. 1 is an orthographic view, taken in elevation, of the instant invention.
Figure 2:
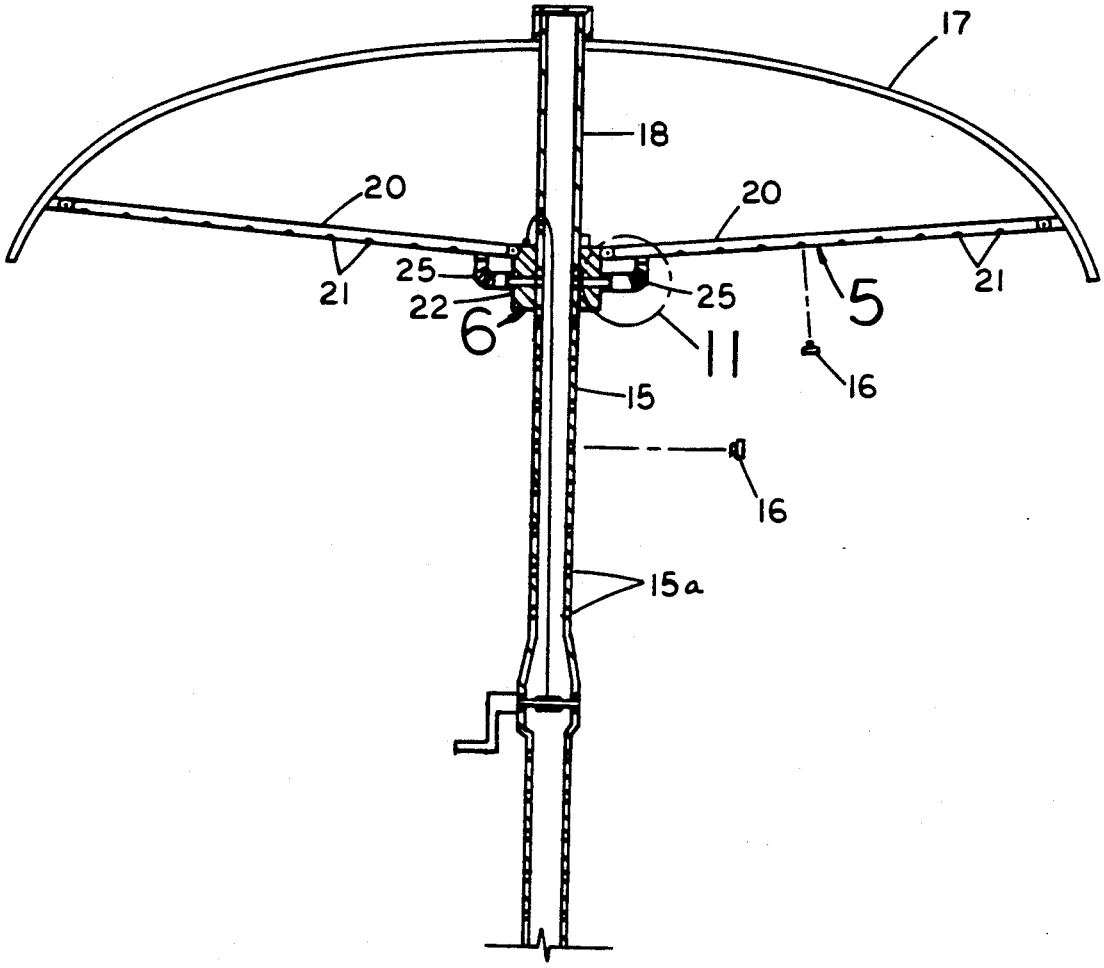
FIG. 2 is an orthographic view, taken along the lines 2—2 of FIG. 1 in the direction indicated by the arrows.
Figure 3:
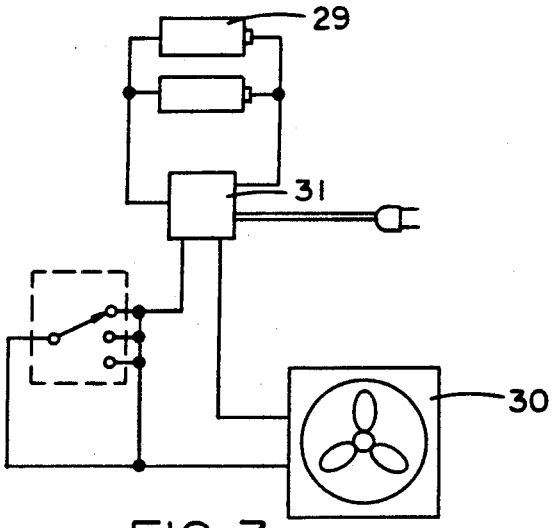
FIG. 3 is a diagrammatic illustration of the compressor organization utilized by the invention.

With reference now to the drawings, and in particular to FIGS. 1 to 11 thereof, a new and improved air flow lounge umbrella apparatus embodying the principles and concepts of the present invention and generally designated by the reference numeral 10 will be described.

More specifically, the air flow lounge umbrella apparatus 10 of the instant invention essentially comprises a support base housing 11, including an umbrella tubular post support structure 13 directed upwardly and in a coaxially aligned relationship relative to the support base housing 11 mounting a table platform 12 coaxially thereabout positioned below an associated foldable umbrella canopy 17.

Figure 5:
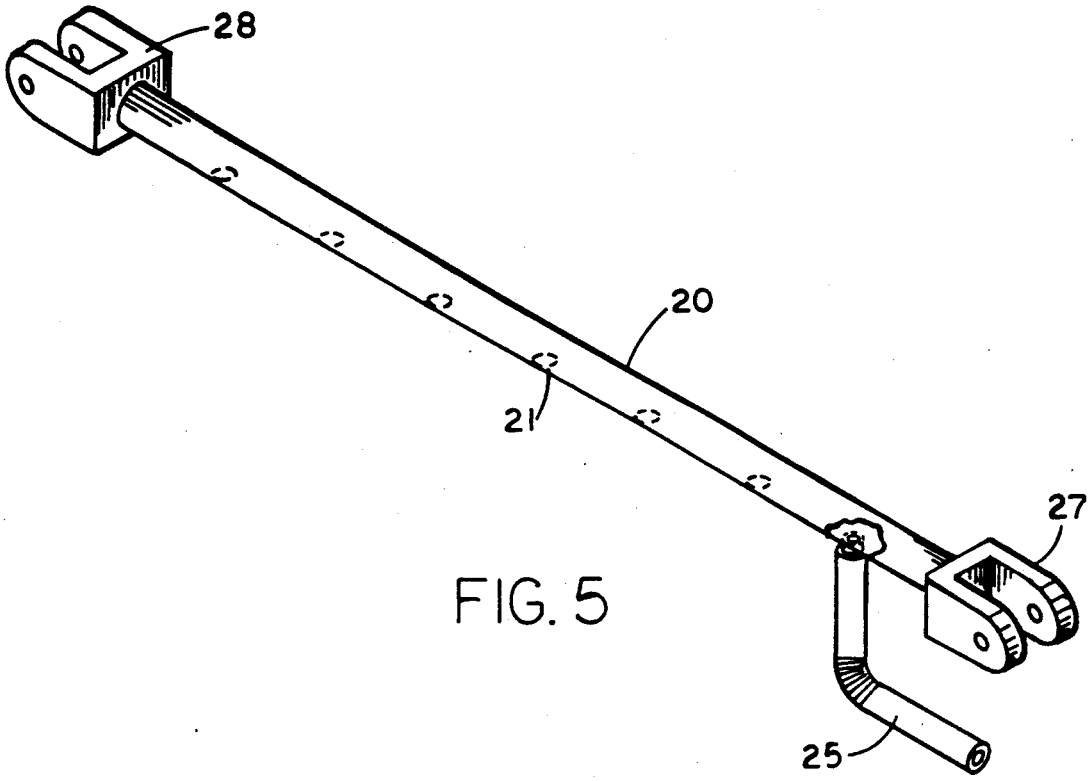
FIG. 5 is an isometric illustration of a canopy support rod utilized by the invention.
Figure 6:
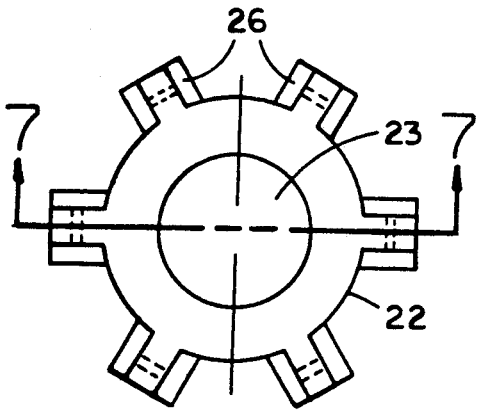
FIG. 6 is an orthographic top view of the air flow manifold structure utilized in association with the canopy support rods.
Figure 7:
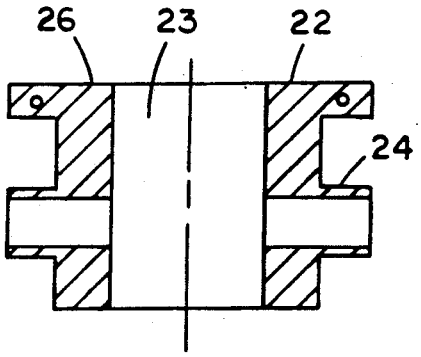
FIG. 7 is an orthographic view, taken along the lines 7—7 of FIG. 6 in the direction indicated by the arrows.
Figure 8:
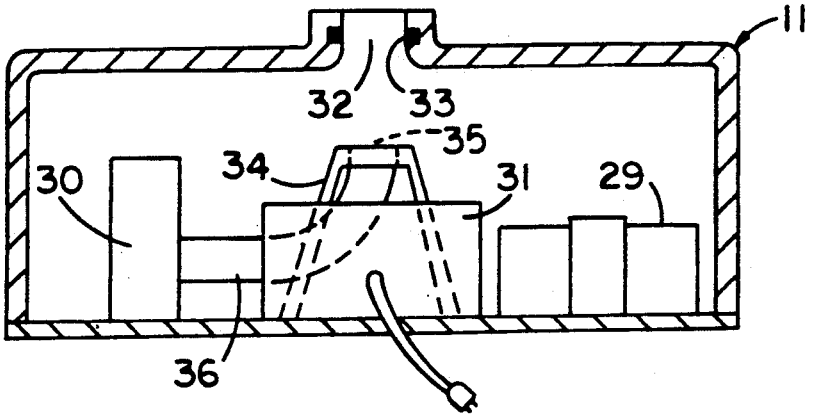
FIG. 8 is an orthographic view, taken along the lines 8—8 of FIG. 1 in the direction indicated by the arrows.
Figure 9:
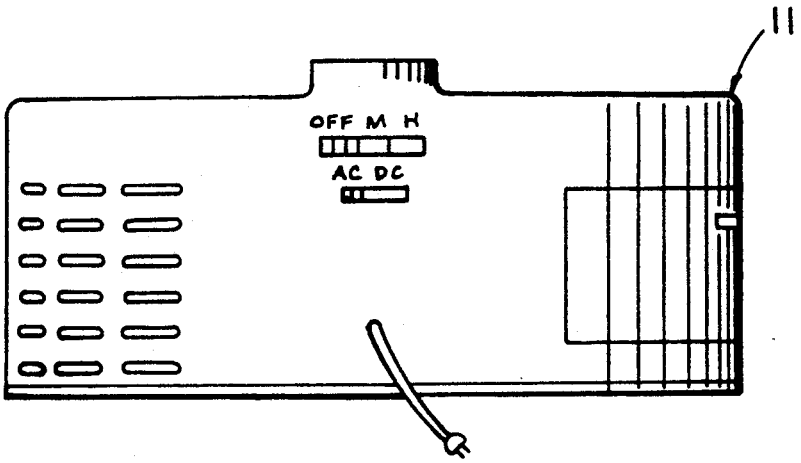
FIG. 9 is an orthographic view, taken along the lines 9—9 of FIG. 1 in the direction indicated by the arrows.
Figure 10:
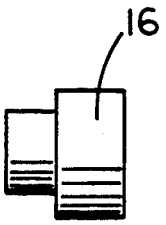
FIG. 10 is an enlarged orthographic side view of the aperture plug as utilized by the invention.
Figure 11:
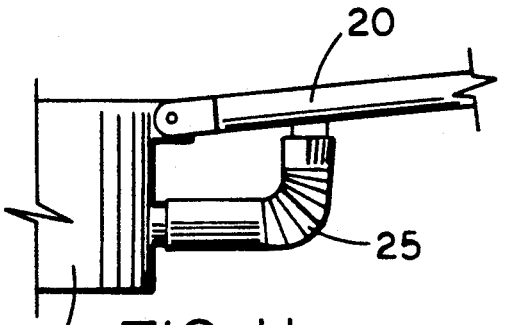
FIG. 11 is an orthographic side view of section 11, as set forth in FIG. 2.

The tubular post support structure 13 includes a first conduit portion 14 formed with a solid impermeable cylindrical wall positioned below the table platform 12, with a second conduit portion 15 extending from the table platform 12 upwardly to an associated manifold block 22, with a third conduit portion 18 extending upwardly from the manifold block 22 supporting the associated umbrella canopy 17 concentrically thereabout. The second conduit portion 15 includes a matrix of aperture openings 15*a* coextensively directed throughout the second conduit portion's wall, wherein the aperture openings 15*a* are selectively sealed by an associated aperture plug 16 of a plurality of such apertures plugs to permit cessation of air flow through the second conduit portion 15. The apertures plugs 16 are thereby complementarily received within the aperture openings 15. A plurality of canopy support rods 20 are provided to support the umbrella canopy 17 that is foldable relative to the umbrella tubular post portion 13, wherein the canopy support rods 20 are each pivotally mounted by canopy rod bifurcated rear end portion 27, that in turn is pivotally mounted to an associated pivot support boss 26 extending radially relative to the manifold block 22 by an associated axle pin. A canopy rod forward bifurcated end 28 is pivotally mounted to the canopy cover 17. The canopy support rods 20 include a plurality of canopy support openings 21 directed through the canopy support rod 20 in confrontation with the table platform 12 to direct pressurized air downwardly to individuals seated about the table platform 12. As illustrated, the pivot support bosses 26 are directed radially and exteriorly of the manifold block 22 and are positioned in alignment above an associated manifold block feed conduit 24 in pneumatic communication with a manifold block central conduit 23 that in turn is fixedly secured about the umbrella tubular post portion 13. The manifold block feed conduits 24 are in turn thereby in pneumatic communication through the umbrella tubular post portion 13 to the support base housing 11. A flexible conduit coupling 25 pneumatically associates the respective manifold feed conduit 24 to each respective canopy support rod 20, in a manner as illustrated in FIG. 5.

Figure 4:
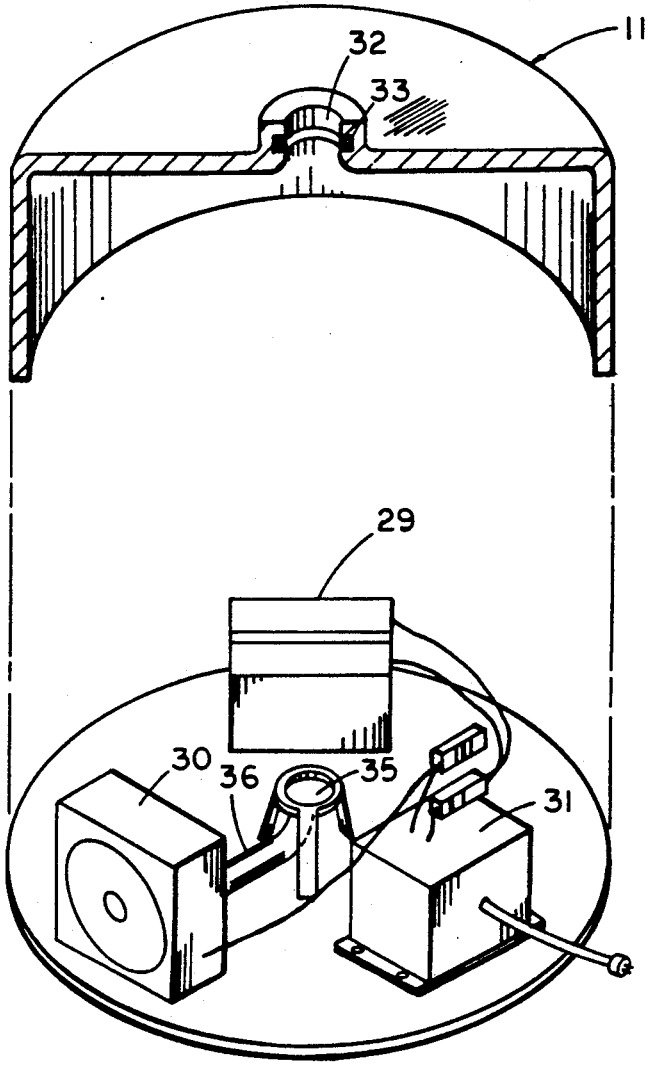
FIG. 4 is an isometric, somewhat exploded view, of the base structure of the invention.

The support base housing 11, such as illustrated and exemplified in FIG. 4, utilizes a battery pack 29 in cooperation with a transformer 31 and a compressor 30. In this manner, selective use of AC or DC power may be utilized to direct the pressurized air from the compressor 30 into a lower distal end of the umbrella tubular post portion 13, and specifically through the first conduit portion 14. The compressor 30 includes a compressor output hose 36. The compressor output hose 36 is directed into a hollow support cone 34 mounted coaxially and medially on a base floor of the base housing 11 to direct the pressurized air through a support cone opening 35. In this manner, the cone is thereby sealingly received within the lower distal end of the umbrella tubular post 13 to provide for a sealing constant flow of pressurized air into the first conduit 14 to thereby direct the air into the second conduit portion 15 and thereafter into each respective canopy support rod 20. The base housing 11 includes a top wall, with a base opening 32 sealingly receiving umbrella post first conduit portion 14 therethrough by use of a base opening annular seal 33 providing a sealing relationship between the base opening 32 and the first conduit portion 14. In this manner, individuals are availed of a constant stream of pressurized and cooling air as desired and controlled by the selective use of the aperture plug 16.

It should be further noted that alternatively, the aperture openings 15*a* may be controlled by mesh screen openings to diffuse air directed therethrough or selectively by louvers positioned about the tubular post portion 13. The tubular post portion 13 may be formed in a multiplicity of take-up part portions to permit selectively disassembly as required of the tubular post 13. It is further conventional that the table platform 12 be of convenience of dimensional configuration, such as fifty-four inches as is conventional in the industry, but may be of any desired diameter to accommodate individuals in surrounding relationship relative to the table platform 12. Further if required, valving may be provided to effect closure of air directed into the canopy support rods 20 to provide selective convenient air flow as desired thereto.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An air flow lounge umbrella apparatus, comprising, a support base housing, the support base housing including a support base housing top wall, the top wall including an umbrella tubular post member received therethrough coaxially aligned with the support base housing and extending upwardly thereof, and including a table platform fixedly mounted to the tubular post member in a surrounding coaxially aligned relationship spaced above the support base housing, and an umbrella canopy mounted to the tubular post member above the table platform, and the tubular post member including a first conduit portion extending from the table platform into the support base housing, and the tubular post member defining a second conduit portion extending from the table platform to a manifold block fixedly mounted to the tubular post member within the umbrella canopy, and a third conduit portion extending from the manifold block medially and coaxially of the umbrella canopy, and the second conduit portion including a matrix of apertures directed therethrough, and the first conduit portion and the second conduit portion in pneumatic communication with air means mounted within the support base housing for directing pressurized air through the first conduit portion and the second conduit portion and through the apertures, and the air means includes a compressor mounted within the support base housing, the support base housing including a base housing floor, with the compressor mounted to the base housing floor, and the base housing floor further including a hollow support cone mounted coaxially of the floor, wherein the cone is received within the lower distal end of the first conduit portion, and a compressor output hose in pneumatic communication between the compressor and the lower distal end of the first conduit portion, with the compressor output hose directed through the hollow support cone in pneumatic communication with the lower distal end of the first conduit portion, wherein the hollow support cone includes a hollow support cone opening arranged for reception within the lower distal end of the first conduit portion.

2. An apparatus as set forth in claim 1 including a plurality of resilient aperture plugs, wherein a resilient aperture plug of said plurality of resilient aperture plugs is arranged for projection within an associated aperture of the second conduit portion.

3. An apparatus as set forth in claim 2 wherein the manifold block includes a plurality of radially projecting pivot support bosses defined by a predetermined number of pivot support bosses, and a predetermined number of canopy support rods, wherein each pivot support boss of said plurality of pivot support bosses includes a canopy support rod of a plurality of canopy support rods pivotally mounted thereto, wherein each canopy support rod includes a bifurcated rear distal end pivotally mounted to a respective pivot support boss, and each canopy support rod includes a bifurcated forward distal end pivotally mounted to a perimeter of the canopy, and each canopy support rod includes a plurality of canopy support rod openings directed through the canopy support rod and the canopy support rod openings are in confrontation to a top surface of the table platform, and manifold block includes a predetermined number of manifold block feed conduits, each feed conduit of said predetermined number of feed conduits in pneumatic communication with the second conduit portion, and a flexible conduit coupling providing pneumatic communication between each feed conduit and a support rod to direct pressurized air from the second conduit portion into the canopy support rods through the manifold blocks.

4. An apparatus as set forth in claim 3 wherein the top wall of the support base opening includes a base opening, and the base opening is arranged to sealingly receive the first conduit portion therethrough, and the base opening includes an annular seal mounted therewithin to effect a sealing of the base housing top wall with the first conduit portion.

* * * * *